US010211536B2

(12) United States Patent
Liang et al.

(10) Patent No.: US 10,211,536 B2
(45) Date of Patent: Feb. 19, 2019

(54) ANTENNA STRUCTURE AND WIRELESS COMMUNICATION DEVICE USING SAME

(71) Applicant: Chiun Mai Communication Systems, Inc., New Taipei (TW)

(72) Inventors: Chia-Ming Liang, New Taipei (TW); Sheng-Chieh Liang, New Taipei (TW); Ming-Yu Chou, New Taipei (TW); Chang-Hsin Ou, New Taipei (TW); Cheng-I Chang, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 0 days.

(21) Appl. No.: 15/690,304

(22) Filed: Aug. 30, 2017

(65) Prior Publication Data

US 2018/0062270 A1 Mar. 1, 2018

Related U.S. Application Data

(60) Provisional application No. 62/382,762, filed on Sep. 1, 2016.

(30) Foreign Application Priority Data

Dec. 29, 2016 (CN) ..... 2016 1 1243441

(51) Int. Cl.
*H01Q 13/10* (2006.01)
*H01Q 5/335* (2015.01)
(Continued)

(52) U.S. Cl.
CPC ..... *H01Q 13/106* (2013.01); *H01Q 1/243* (2013.01); *H01Q 1/42* (2013.01); *H01Q 3/24* (2013.01); *H01Q 5/328* (2015.01); *H01Q 5/335* (2015.01); *H01Q 9/42* (2013.01); *H01Q 1/2291* (2013.01); *H01Q 1/48* (2013.01); *H01Q 5/30* (2015.01); *H01Q 7/00* (2013.01)

(58) Field of Classification Search
CPC ..... H01Q 1/48; H01Q 1/2291; H01Q 7/00; H01Q 1/243; H01Q 5/30; H01Q 5/335; H01Q 13/16
See application file for complete search history.

(56) References Cited

U.S. PATENT DOCUMENTS

2013/0169490 A1 7/2013 Pascolini et al.
2014/0266941 A1 9/2014 Vazquez et al.
(Continued)

*Primary Examiner* — Joseph Lauture
(74) *Attorney, Agent, or Firm* — ScienBiziP, P.C.

(57) ABSTRACT

An antenna structure includes a housing, a first connecting portion, a matching unit, a second connecting portion, and a first switching circuit. The housing defines a slot, a first gap, and a second gap. The housing is divided into a first portion and a second portion by the slot, the first gap, and the second gap. The second portion is grounded. One end of the first connecting portion electrically connected to the first portion and another end of the first connecting portion electrically connected to a feed point through the matching unit. The first portion is divided into a first radiating portion and a second radiating portion by the first connecting portion. One end of the second connecting portion is electrically connected to the first radiating portion and another end of the second connecting portion is grounded through the first switching circuit.

25 Claims, 24 Drawing Sheets

(51) Int. Cl.

| | |
|---|---|
| ***H01Q 5/328*** | (2015.01) |
| ***H01Q 1/42*** | (2006.01) |
| ***H01Q 3/24*** | (2006.01) |
| ***H01Q 1/24*** | (2006.01) |
| ***H01Q 9/42*** | (2006.01) |
| *H01Q 5/30* | (2015.01) |
| *H01Q 1/22* | (2006.01) |
| *H01Q 7/00* | (2006.01) |
| *H01Q 1/48* | (2006.01) |

(56) References Cited

U.S. PATENT DOCUMENTS

2014/0329558 A1 11/2014 Darnell et al.
2018/0123234 A1* 5/2018 Wang ..... H01Q 1/2291

* cited by examiner

ANTENNA STRUCTURE AND WIRELESS COMMUNICATION DEVICE USING SAME

CROSS-REFERENCE TO RELATED APPLICATIONS

This application claims priority to Chinese Patent Application No. 201611243441.X filed on Dec. 29, 2016, claims priority to U.S. Patent Application No. 62/382,762 filed on Sep. 1, 2016, the contents of which are incorporated by reference herein.

FIELD

The subject matter herein generally relates to an antenna structure and a wireless communication device using the antenna structure.

BACKGROUND

Metal housings, for example, metallic backboards, are widely used for wireless communication devices, such as mobile phones and personal digital assistants (PDAs). Antennas are also important components in wireless communication devices for receiving and transmitting wireless signals at different frequencies, such as signals in Long Term Evolution Advanced (LTE-A) frequency bands. However, when the antenna is located in the metal housing, the antenna signals are often shielded by the metal housing. This can degrade the operation of the wireless communication device.

BRIEF DESCRIPTION OF THE DRAWINGS

Implementations of the present disclosure will now be described, by way of example only, with reference to the attached figures.

DETAILED DESCRIPTION

Figure 1:
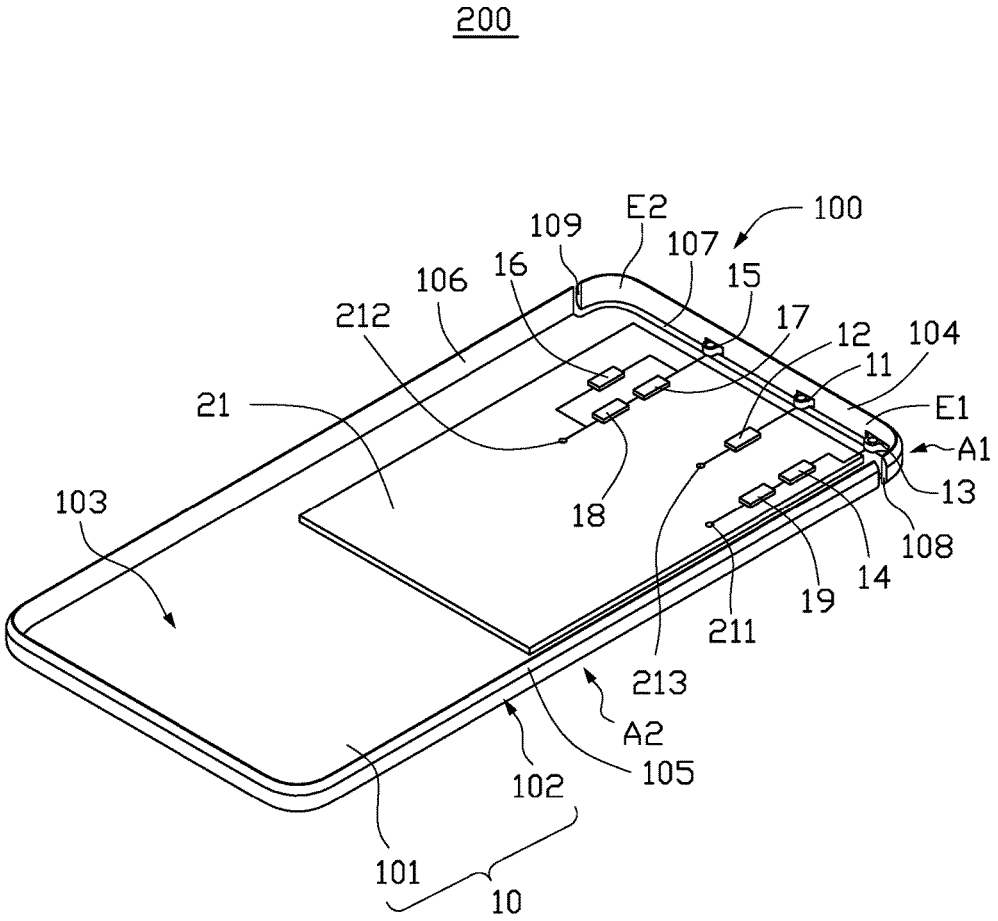
FIG. 1 is an isometric view of a first exemplary embodiment of a wireless communication device using a first exemplary antenna structure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series, and the like.

The present disclosure is described in relation to an antenna structure and a wireless communication device using same.

FIG. 1 illustrates an exemplary embodiment of a wireless communication device 200 using a first exemplary antenna structure 100. The wireless communication device 200 can be a mobile phone or a personal digital assistant, for example. The antenna structure 100 can receive and transmit wireless signals.

The wireless communication device 200 further includes a baseboard 21. The baseboard 21 can be made of dielectric material, such as epoxy resin glass fiber (FR4). The baseboard 21 includes a first ground point 211, a second ground point 212, and a feed point 213. The first ground point 211 and the second ground point 212 are on the baseboard 21 and spaced apart from each other. The first ground point 211 and the second ground point 212 both ground the antenna structure 100. The feed point 213 is between the first ground point 211 and the second ground point 212. The feed point 213 supplies current to the antenna structure 100.

Figure 2:
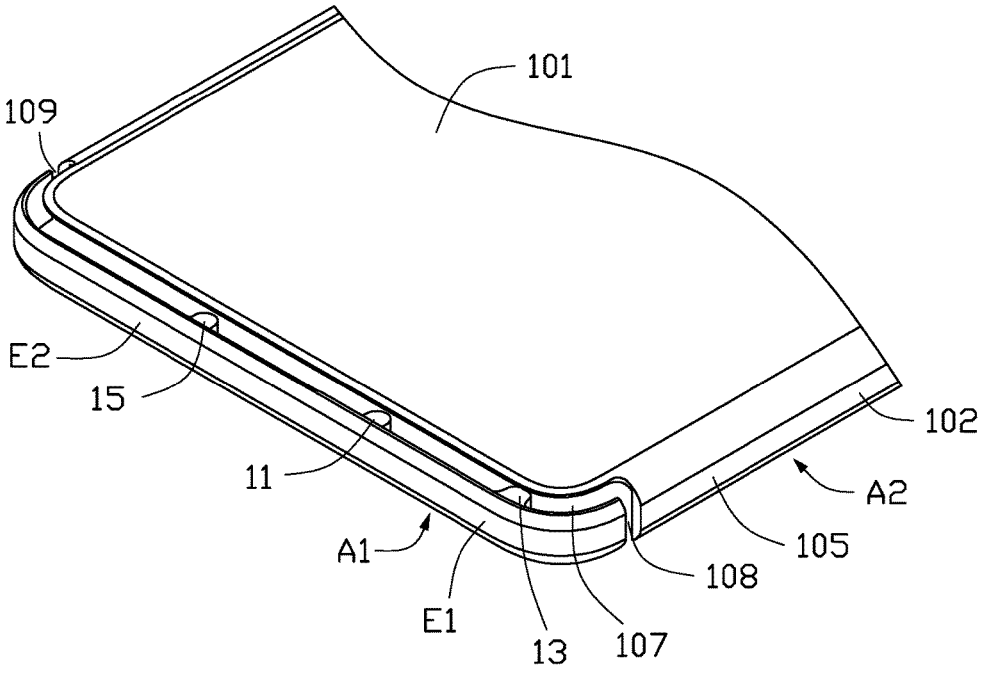
FIG. 2 is similar to FIG. 1, but shown from another angle.

As illustrated in FIG. 1 and FIG. 2, the antenna structure 100 includes a housing 10, a first connecting portion 11, a matching unit 12, a second connecting portion 13, a first switching circuit 14, a third connecting portion 15, and a first matching circuit 16. The housing 10 houses the wireless communication device 200. In this exemplary embodiment, the housing 10 is made of metallic material. The housing 10 includes a backboard 101 and a side frame 102. The backboard 101 and the side frame 102 can be integrally formed with each other. The side frame 102 is positioned around a periphery of the backboard 101. The side frame 102 forms a receiving space 103 together with the backboard 101. The receiving space 103 can receive the baseboard 21, a printed circuit board, a processing unit, or other electronic components or modules (not shown).

In this exemplary embodiment, the side frame 102 includes an end portion 104, a first side portion 105, and a second side portion 106. The first side portion 105 is spaced apart from and parallel to the second side portion 106. The end portion 104 has first and second ends. The first side portion 105 is connected to the first end of the first frame 111 and the second side portion 106 is connected to the second end of the end portion 104. In this exemplary embodiment, the end portion 104 can be a top portion or a bottom portion of the wireless communication device 200.

The housing 10 further defines a slot 107, a first gap 108, and a second gap 109. In this exemplary embodiment, the slot 107 is substantially U-shaped. The slot 107 is defined on the backboard 101 adjacent to the end portion 104. The first gap 108 and the second gap 109 are both defined on the side frame 102. The first gap 108 is defined on the first side portion 105. The second gap 109 is defined on the second side portion 106. The first gap 108 and the second gap 109 are both in air communication with the slot 107 and extend to cut across the side frame 102. The housing 10 is divided into two portions by the slot 107, the first gap 108, and the second gap 109. The two portions are a first portion A1 and a second portion A2.

In other exemplary embodiments, a shape of the slot 107 is not limited to be U-shaped and can be, for example, a straight strip, an oblique line, or a meander.

In this exemplary embodiment, the slot 107 is defined on the backboard 101 adjacent to the end portion 104 and extends to an edge of the end portion 104. The first portion A1 is completely formed by the end portion 104, a portion of the first side portion 15, and a portion of the second side portion 106, that is, the first portion A1 is formed by a portion of the side frame 102. In other exemplary embodiments, a position of the slot 107 can be adjusted. For example, the slot 107 can be defined on a middle portion of the backboard 101. The first portion A1 is formed by a portion of the side frame 102 and a portion of the backboard 101.

In other exemplary embodiments, a location of the slot 107 is not limited to be the backboard 101 and the slot 107 can be defined on the end portion 104.

In other exemplary embodiments, locations of the first gap 108 and the second gap 109 can be adjusted. For example, the first gap 108 and the second gap 109 are both defined on the end portion 104. For example, one of the two gaps, the first gap 108 and the second gap 109, is defined on the end portion 104. The other one of the two gaps, the first gap 108 and the second gap 109, is defined on one of the first side portion 105 and the second side portion 106. That is, a shape and a location of the slot 107, locations of the first gap 108 and the second gap 109 on the side frame 102 can be adjusted, to ensure that the housing 10 can be divided into the first portion A1 and the second portion A2 by the slot 107, the first gap 108, and the second gap 109.

Figure 3:
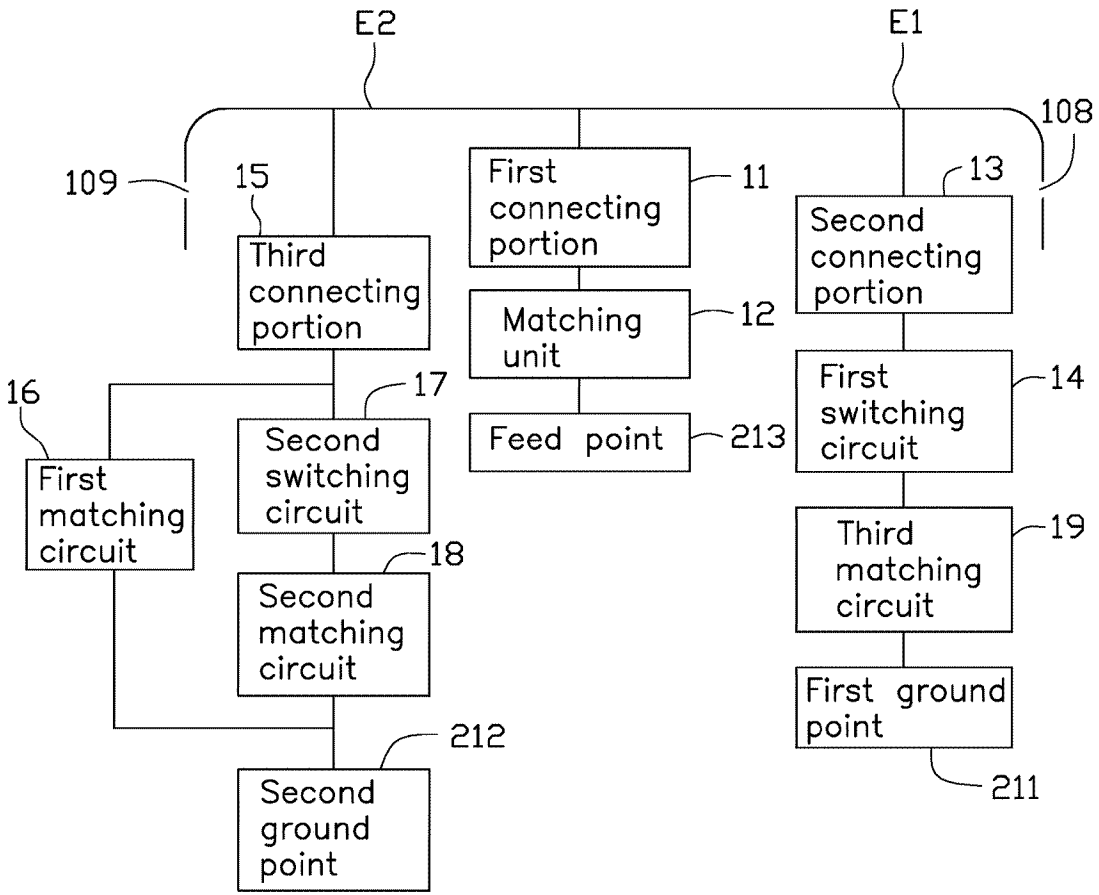
FIG. 3 is a circuit diagram of the antenna structure of FIG. 1.

As illustrated in FIG. 1 and FIG. 3, in this exemplary embodiment, the first connecting portion 11 can be a shrapnel, a screw, a microstrip line, a probe, or other connecting structures. One end of the first connecting portion 11 is electrically connected to the end of the first portion A1 adjacent to the first gap 108. Another end of the first connecting portion 11 is electrically connected to the feed point 213 through the matching unit 12 to supply current to the first portion A1.

The first portion A1 is divided into a first radiating portion E1 and a second radiating portion E2 by the first connecting portion 11. The portion of the side frame 102 from the first gap 108 to the position of the side frame 102 connecting to the first connecting portion 11 forms the first radiating portion E1. The portion of the side frame 102 from the second gap 109 to the position of the side frame 102 connecting to the first connecting portion 11 forms the second radiating portion E2.

In this exemplary embodiment, the position of the side frame 102 connecting to the first connecting portion 11 is not at a middle portion of the end portion 104. The second radiating portion E2 is longer than the first radiating portion E1. The second portion A2 is longer than the second radiating portion E2. The second portion A2 is shorter than the first radiating portion E1.

The second connecting portion 13 can be a shrapnel, a screw, a microstrip line, a probe, or other connecting structures. One end of the second connecting portion 13 is electrically connected to the end of the first radiating portion E1 adjacent to the first gap 108. Another end of the second connecting portion 13 is electrically grounded to the first ground point 211 through the first switching circuit 14.

Figure 4:
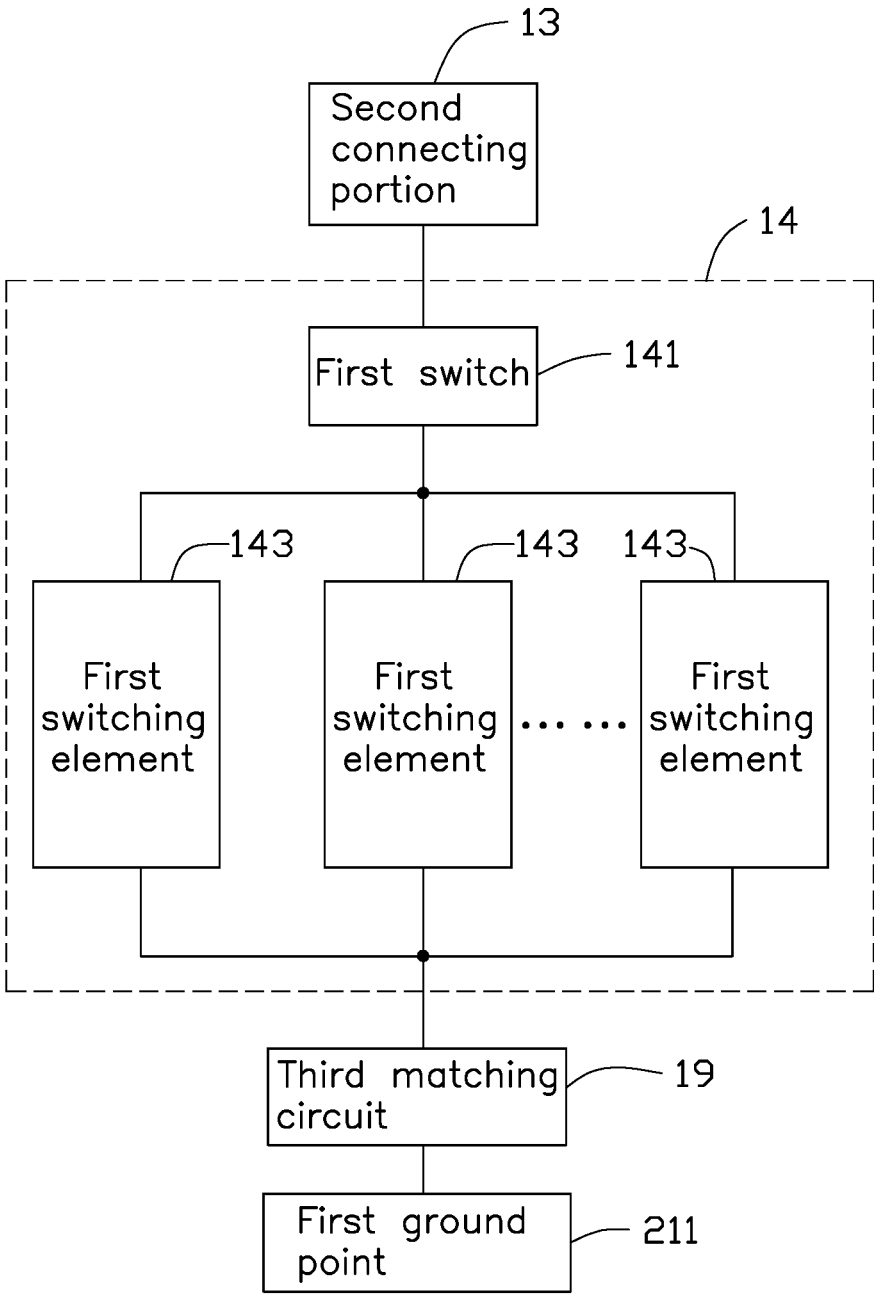
FIG. 4 is a circuit diagram of a first switching circuit of the antenna structure of FIG. 1.

As illustrated in FIG. 4, in this exemplary embodiment, the first switching circuit 14 includes a first switch 141 and a plurality of first switching elements 143. The first switch 141 can be a single pole single throw switch, a single pole double throw switch, a single pole three throw switch, a single pole four throw switch, a single pole six throw switch, a single pole eight throw switch, or the like. The first switch 141 is electrically connected to the second connecting portion 13 and is electrically connected to the first radiating portion E1 through the second connecting portion 13.

The first switching elements 143 can be an inductor, a capacitor, or a combination of the inductor and the capacitor. The first switching elements 143 are connected in parallel to each other. One end of each first switching element 143 is electrically connected to the first switch 141. The other end of each first switching element 143 is electrically grounded to the first ground point 211.

Through control of the first switch 141, the first radiating portion E1 can be switched to connect with different first switching elements 143. Since each first switching element 143 has a different impedance, an operating frequency band of the first radiating portion E1 can be adjusted.

The third connecting portion 15 can be a shrapnel, a screw, a microstrip line, a probe, or other connecting structures. One end of the third connecting portion 15 is electrically connected to the end of the second radiating portion E2 adjacent to the first connecting portion 11. Another end of the third connecting portion 15 is electrically grounded to the second ground point 212 through the first matching circuit 16.

In this exemplary embodiment, the antenna structure 100 further includes a second switching circuit 17 and a second matching circuit 18. The second switching circuit 17 and the second matching circuit 18 are connected in series. The first matching circuit 16 is connected in parallel with the second switching circuit 17 and the second matching circuit 18 connected in series. That is, the second switching circuit 17 and the second matching circuit 18 are connected between the third connecting portion 15 and the second ground point 212.

Figure 5:
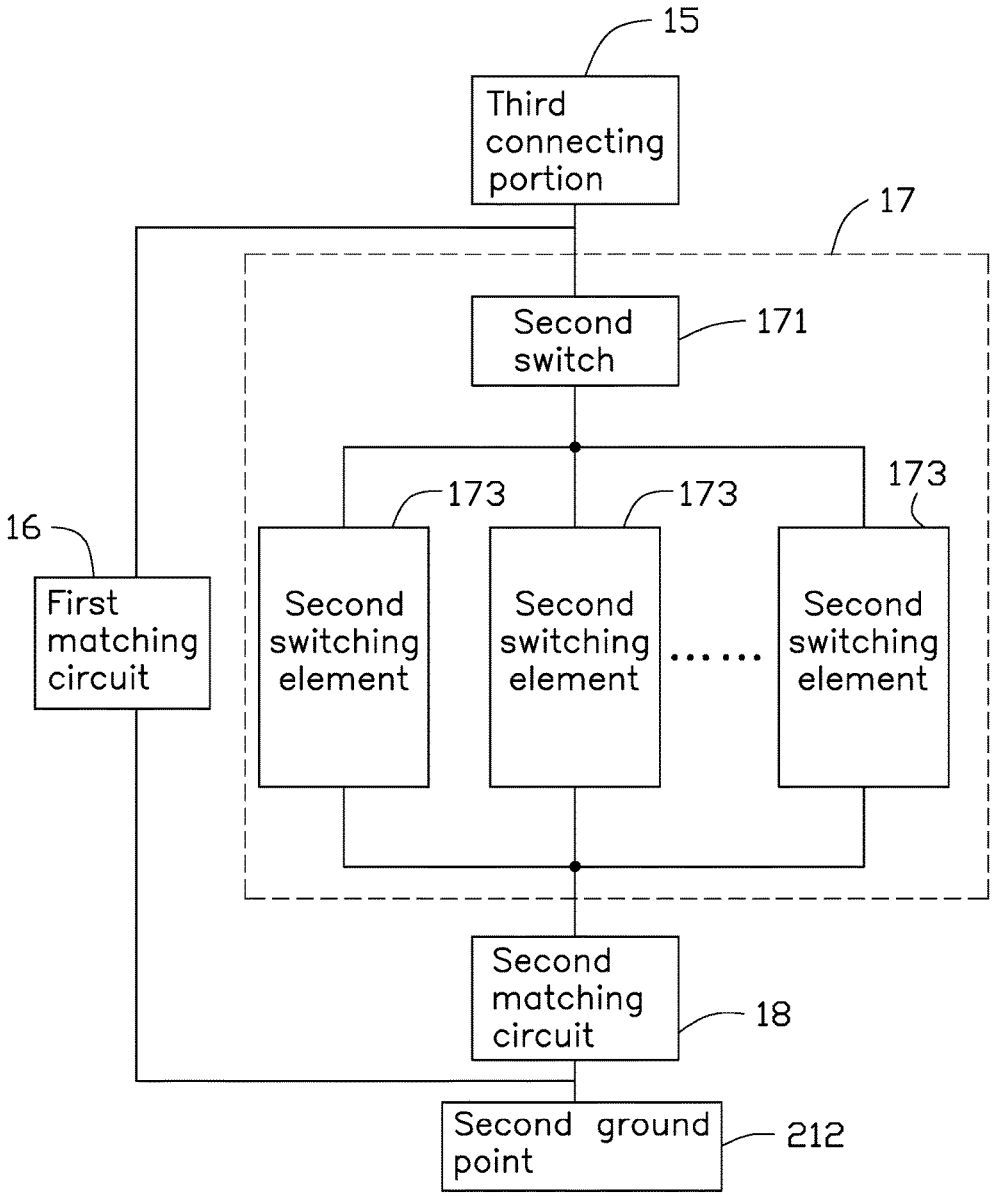
FIG. 5 is a circuit diagram of a second switching circuit of the antenna structure of FIG. 1.

As illustrated in FIG. 5, in this exemplary embodiment, the second switching circuit 17 includes a second switch 171 and a plurality of second switching elements 173. The second switch 171 can be a single pole single throw switch, a single pole double throw switch, a single pole three throw switch, a single pole four throw switch, a single pole six throw switch, a single pole eight throw switch, or the like. The second switch 171 is electrically connected to the third connecting portion 15 and is electrically connected to the second radiating portion E2 through the third connecting portion 15.

The second switching elements 173 can be an inductor, a capacitor, or a combination of the inductor and the capacitor. The second switching elements 173 are connected in parallel to each other. One end of each second switching element 173 is electrically connected to the second switch 171. The other end of each second switching element 173 is electrically grounded to the second ground point 212.

Through control of the second switch 171, the second radiating portion E2 can be switched to connect with different second switching elements 173. Since each second switching element 173 has a different impedance, an operating frequency band of the second radiating portion E2 can be adjusted.

In this exemplary embodiment, the first matching circuit 16 and the second matching circuit 18 can be an L-type matching circuit, a T-type matching circuit, a π-type matching circuit, or other capacitors, inductors, or a combination of the capacitors and the inductors. The first matching circuit 16 and the second matching circuit 18 cooperatively adjust an impedance matching of the second radiating portion E2.

In this exemplary embodiment, the antenna structure 100 further includes a third matching circuit 19. One end of the third matching circuit 19 is electrically connected to the first switching circuit 14. Another end of the third matching circuit 19 is electrically grounded to the first ground point 211. The third matching circuit 19 can be an L-type matching circuit, a T-type matching circuit, a π-type matching circuit, or other capacitors, inductors, or a combination of the capacitors and the inductors. The third matching circuit 19 adjusts an impedance matching of the first radiating portion E1.

Figure 6:
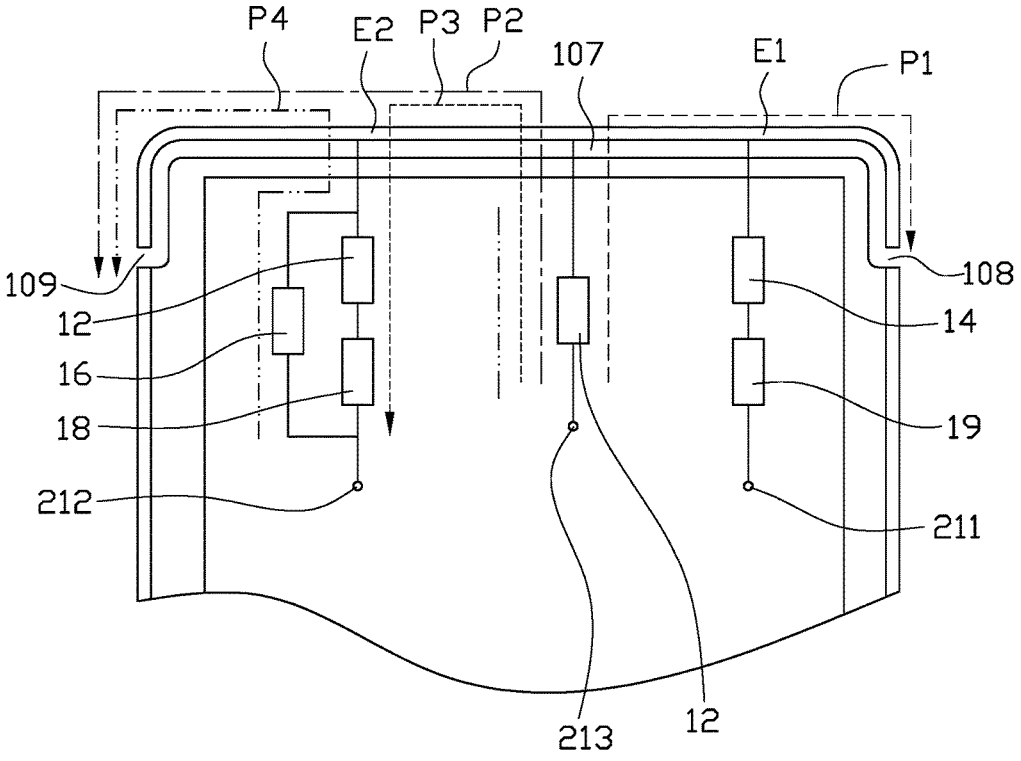
FIG. 6 is a current path distribution graph of the antenna structure of FIG. 1.

As illustrated in FIG. 6, when the feed point 213 supplies current, the current flows through the matching unit 12 and the first connecting portion 11 and flows through the first radiating portion E1. Then the first radiating portion E1 activates a first operation mode to generate radiation signals in a first frequency band (Per path P1). In this exemplary embodiment, the first frequency band is about 2000-2300 MHz.

When the feed point 213 supplies current, the current flows through the first connecting portion 11 through the matching unit 12 and flows through the second radiating portion E2. Then the second radiating portion E2 activates a second operation mode to generate radiation signals in a second frequency band (Per path P2). In this exemplary embodiment, the second operation mode is a low frequency operation mode. The second frequency band is about 699-960 MHz.

When the feed point 213 supplies current, the current flows through the first connecting portion 11 through the matching unit 12, flows to the second radiating portion E2, and is grounded through the third connecting portion 15, the second switching circuit 17, and the second matching circuit 18. Then the antenna structure 100 activates a third operation mode to generate radiation signals in a third frequency band (Per path P3). In this exemplary embodiment, the third operation mode is a high frequency operation mode. The third frequency band is about 2496-2690 MHz (LTE band41).

When the feed point 213 supplies current, the current flows through the first connecting portion 11 through the matching unit 12 and is coupled to the first matching circuit 16. The current from the first matching circuit 16 further flows through the third connecting portion 13 and flows towards the second gap 109 through the third connecting portion 13 and the second radiating portion E2. Then the antenna structure 100 activates a fourth operation mode to generate radiation signals in a fourth frequency band (Per path P4). In this exemplary embodiment, the fourth operation mode is a middle frequency operation mode. The fourth frequency band is about 1710-1880 MHz.

As described above, the antenna structure 100 activates the first operation mode and the third operation mode to generate radiation signals in a high frequency band. The antenna structure 100 activates the second operation mode to generate radiation signals in a low frequency band and activates the fourth operation mode to generate radiation signals in a middle frequency band. The wireless communication device 200 can use carrier aggregation (CA) technology of LTE-A to receive or send wireless signals at multiple frequency bands simultaneously. In detail, the wireless communication device 200 can use the CA technology and use the first portion A1 to receive or transmit wireless signals at multiple frequency bands simultaneously, that is, the wireless communication device 200 can realize 2CA or 3CA simultaneously.

Figure 7:
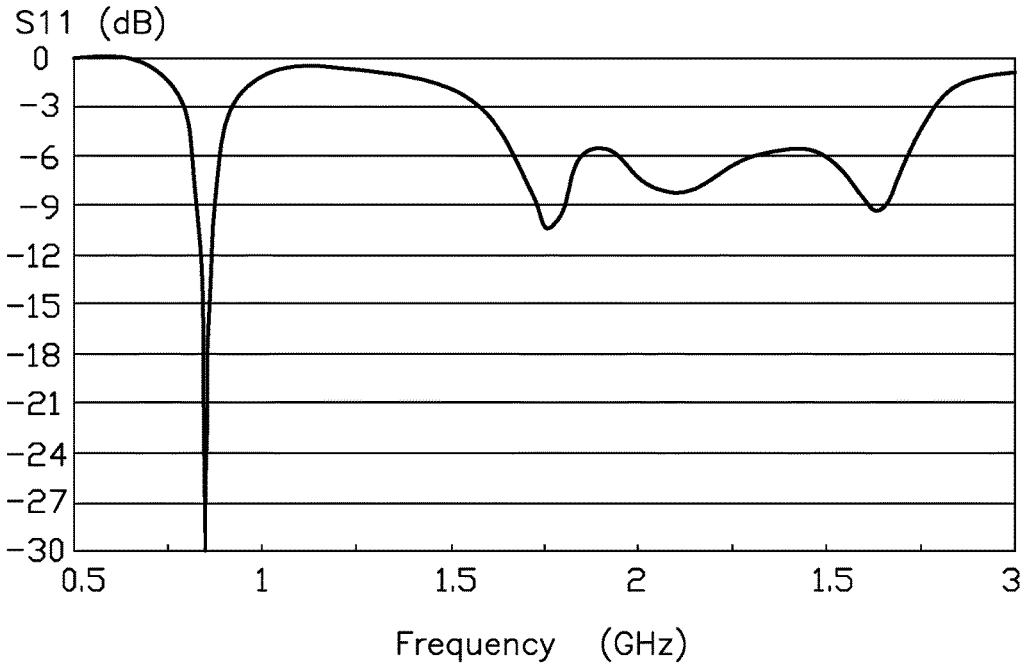
FIG. 7 is a scattering parameter graph of the antenna structure of FIG. 1.
Figure 8:
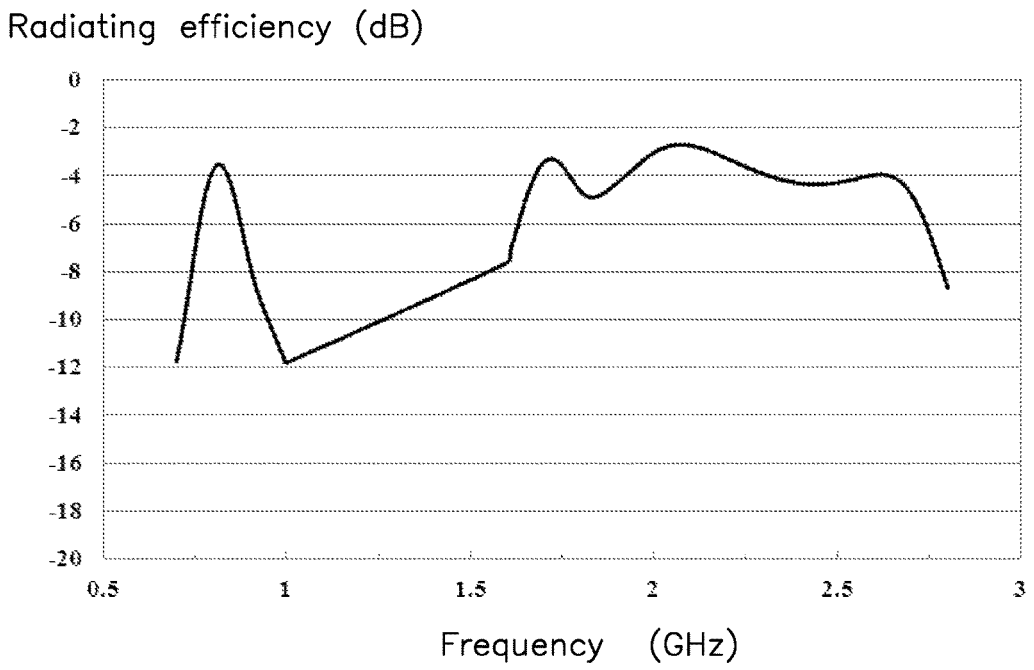
FIG. 8 is a radiating efficiency graph of the antenna structure of FIG. 1.

FIG. 7 illustrates a scattering parameter graph of the antenna structure 100. FIG. 8 illustrates a radiating efficiency graph of the antenna structure 100. The antenna structure 100 may completely cover the system bandwidth required for the currently used communication system. For example, the low frequency of the antenna structure 100 may cover 700-960 MHz. The middle and high frequencies of the antenna structure 100 may cover 1710-1880 MHz, 2000-2300 MHz, and 2496-2690 MHz, which satisfies antenna design requirements.

Figure 9:
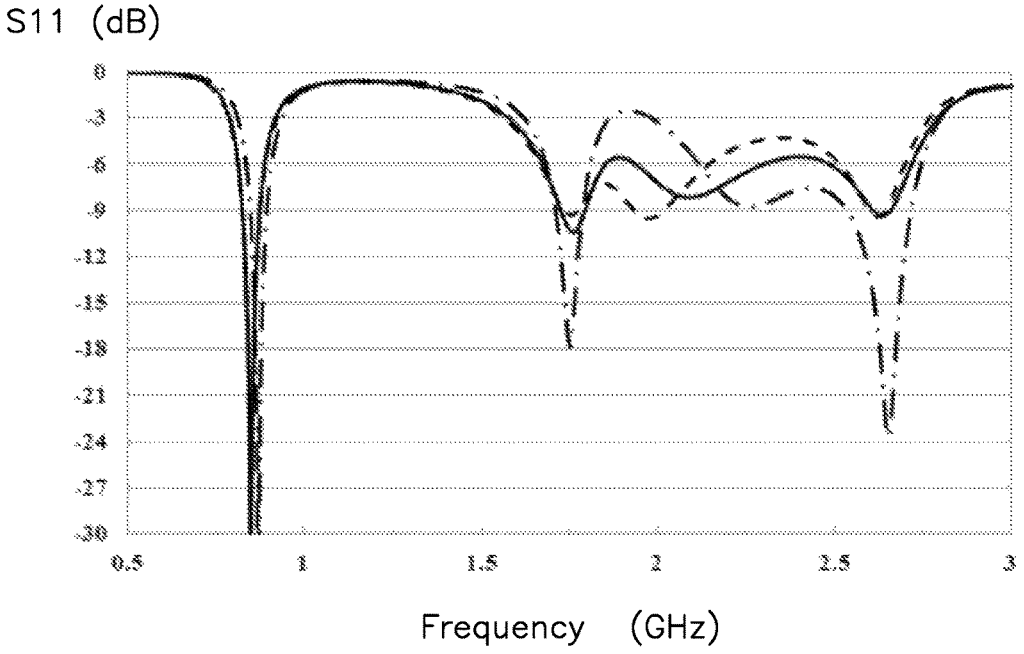
FIG. 9 is a scattering parameter graph illustrating a first switching unit of the first switching circuit of FIG. 4 switching to different first switching elements.
Figure 10:
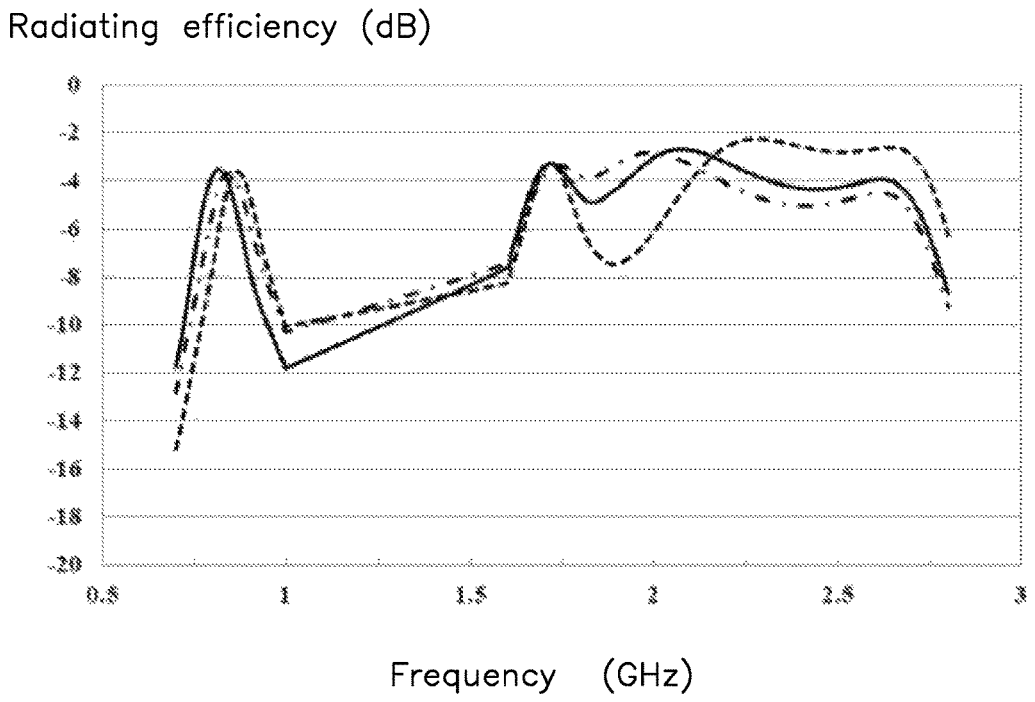
FIG. 10 is a radiating efficiency graph illustrating a first switching unit of the first switching circuit of FIG. 4 switching to different first switching elements.

FIG. 9 illustrates a scattering parameter graph of the antenna structure 100 when the first switch 141 of the first switching circuit 14 switches to different first switching elements 143. FIG. 10 illustrates a radiating efficiency graph of the antenna structure 100 when the first switch 141 of the first switching circuit 14 switches to different first switching elements 143. The first switch 141 of the first switching circuit 14 can switch to different first switching elements 143 (for example three different first switching elements 143). Since each first switching element 143 has a different impedance, an operating frequency band of the middle and high frequency bands of the antenna structure 100 can be adjusted thereby. The antenna structure 100 can obtain a good operation bandwidth and different LTE 2CA combinations (for example, a combination of the low frequency band and the high frequency band, or a combination of the low frequency band and the middle frequency band).

Figure 11:
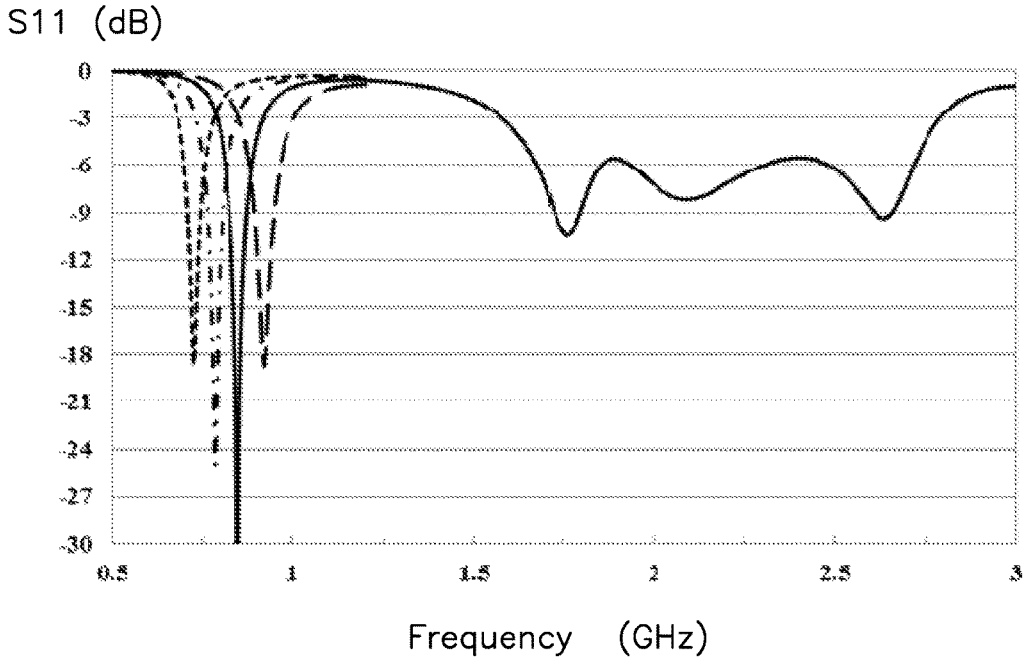
FIG. 11 is a scattering parameter graph illustrating a second switching unit of the second switching circuit of FIG. 5 switching to different second switching elements.
Figure 12:
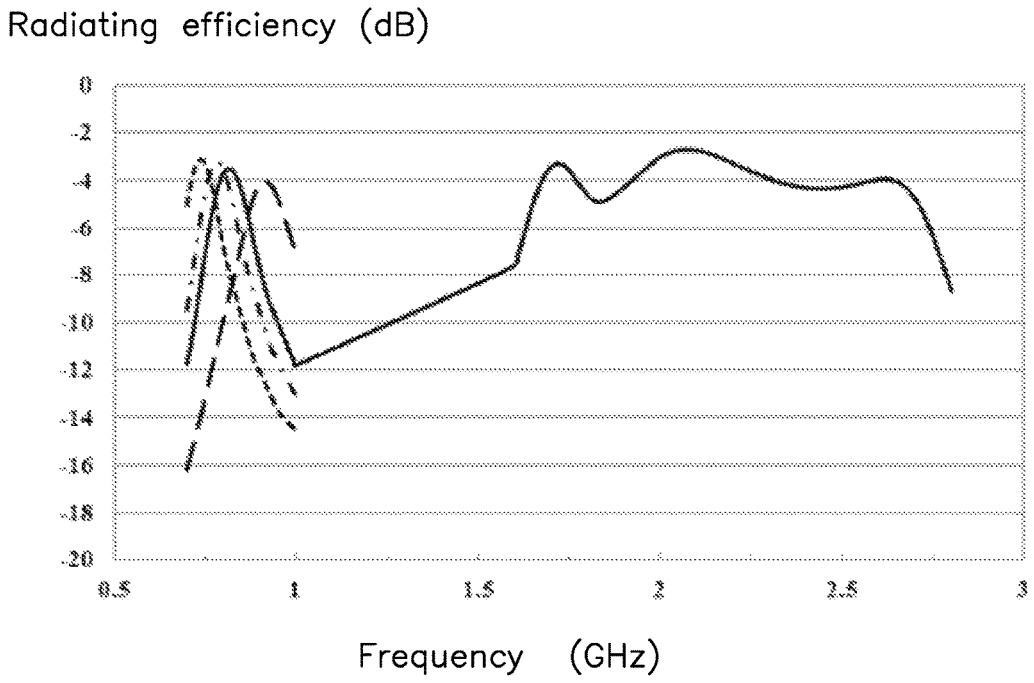
FIG. 12 is a radiating efficiency graph illustrating a second switching unit of the second switching circuit of FIG. 5 switching to different second switching elements.

FIG. 11 illustrates a scattering parameter graph of the antenna structure 100 when the second switch 171 of the second switching circuit 17 switches to different second switching elements 173. FIG. 12 illustrates a radiating efficiency graph of the antenna structure 100 when the second switch 171 of the second switching circuit 17 switches to different second switching elements 173. The second switch 171 of the second switching circuit 17 can switch to different second switching elements 173 (for example four different second switching elements 173). Since each second switching element 173 has a different impedance, an operating frequency band of the low frequency band of the antenna structure 100 can be adjusted. The antenna structure 100 can obtain different LTE 3CA combinations coordinating with the middle frequency band and the high frequency band.

Figure 13:
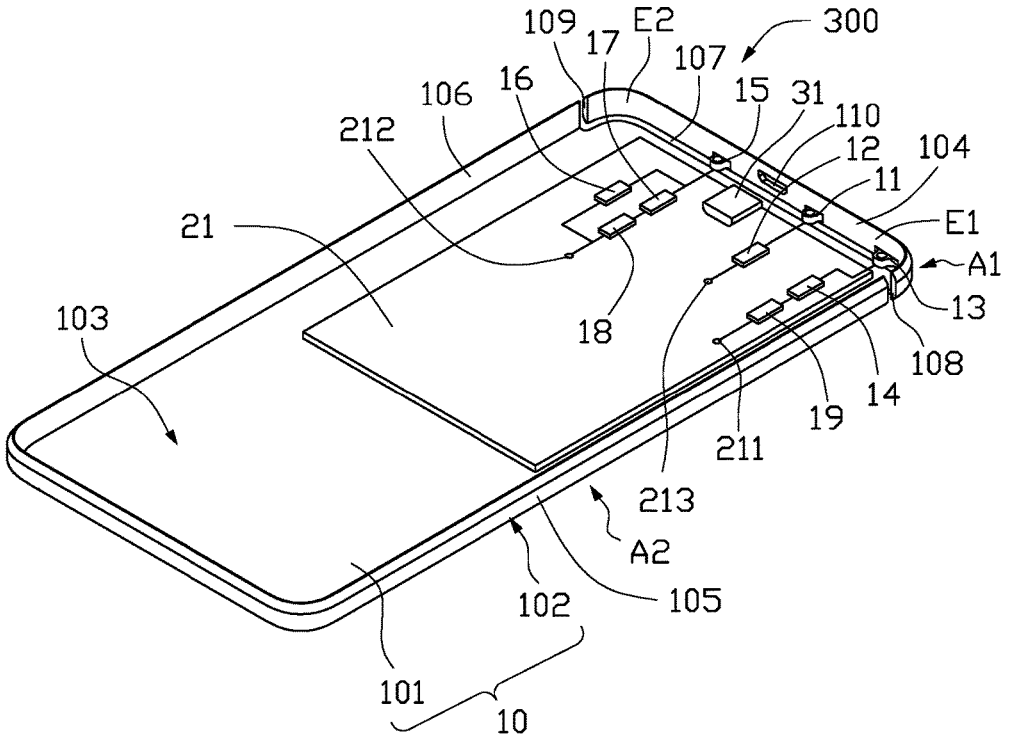
FIG. 13 is an isometric view of a second exemplary embodiment of an antenna structure.

FIG. 13 illustrates a second exemplary antenna structure 300. The antenna structure 300 includes a housing 10, a first connecting portion 11, a matching unit 12, a second connecting portion 13, a first switching circuit 14, a third connecting portion 15, a first matching circuit 16, a second switching circuit 17, a second matching circuit 18, and a third matching circuit 19.

One end of the first connecting portion 11 is electrically connected to the first portion A1. Another end of the first connecting portion 11 is electrically connected to the feed point 213. One end of the second connecting portion 13 is electrically connected to the first portion A1. Another end of the second connecting portion 13 is electrically grounded to the first ground point 211 through the first switching circuit 14 and the third matching circuit 19. One end of the third connecting portion 15 is electrically connected to the second radiating portion E2. Another end of the third connecting portion 15 is electrically grounded to the second ground point 212 through the first matching circuit 16. The third connecting portion 15 is further electrically grounded to the second ground point 212 through the second switching circuit 17 and the second matching circuit 18 connected in series.

The antenna structure 300 differs from the antenna structure 100 in that the antenna structure 300 further includes an electronic element 31. In this exemplary embodiment, the electronic element 31 is a Universal Serial Bus (USB) module. The electronic element 31 is between the first connecting portion 11 and the third connecting portion 15 and is spaced apart from the end portion 104.

In this exemplary embodiment, the second radiating portion E2 further defines a through hole 110. The through hole 110 corresponds to the electronic element 31 and the electronic element 31 is partially exposed from the through hole 110. A USB device can be inserted in the through hole 110 and be electrically connected to the electronic element 31.

Figure 14:
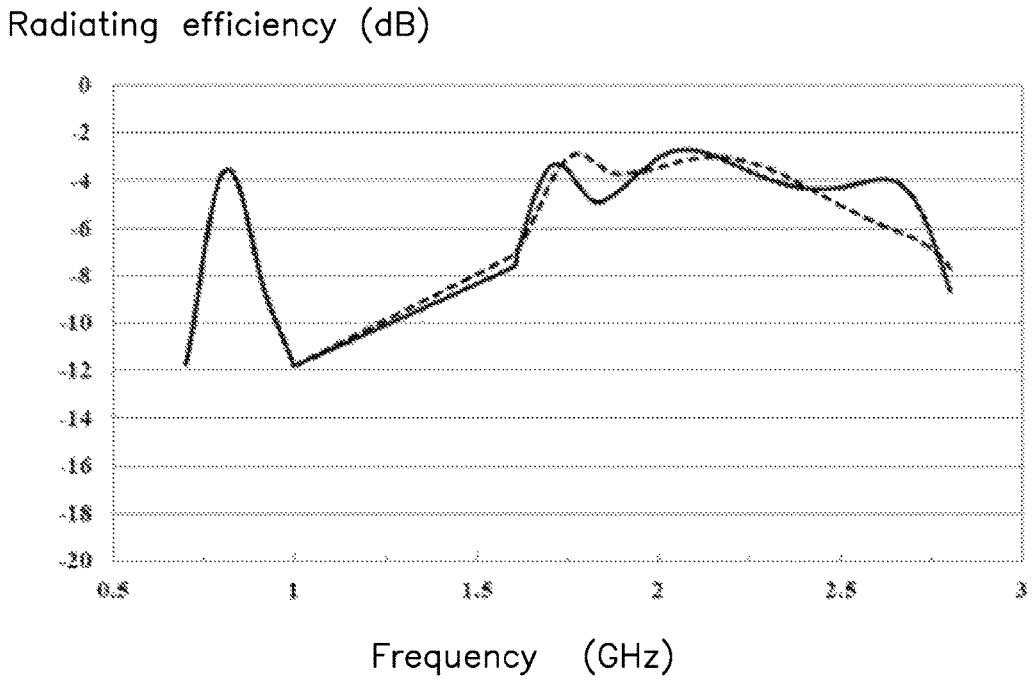
FIG. 14 is a radiating efficiency graph of the antenna structure of FIG. 13.

FIG. 14 illustrates a radiating efficiency graph of the antenna structure 300. When the antenna structure 300 includes the electronic element 31, the electronic element 31 affects a radiating efficiency of a high frequency band of the antenna structure 300, for example, the frequency bands of about LTE band7 (2500-2690 MHz) and LTE band41 (2496-2690 MHz) (a dotted line shown in FIG. 14). However, the antenna structure 300 can adjust and improve the frequency bands of about LTE band7 (2500-2690 MHz) and LTE band41 (2496-2690 MHz) through the first switching circuit 14 and the third matching circuit 19 and has a good radiating efficiency (a solid line shown in FIG. 14).

Figure 15:
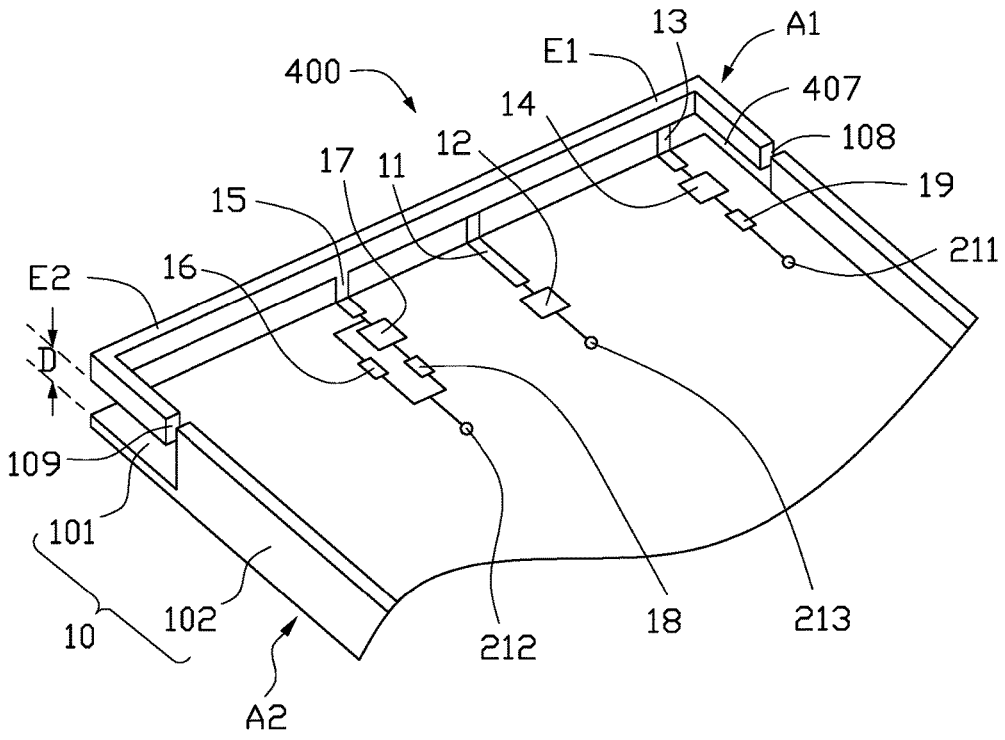
FIG. 15 is an isometric view of a third exemplary embodiment of an antenna structure.

FIG. 15 illustrates a third exemplary antenna structure 400. The antenna structure 400 includes a housing 10, a first connecting portion 11, a matching unit 12, a second connecting portion 13, a first switching circuit 14, a third connecting portion 15, a first matching circuit 16, a second switching circuit 17, a second matching circuit 18, and a third matching circuit 19.

One end of the first connecting portion 11 is electrically connected to the first portion A1. Another end of the first connecting portion 11 is electrically connected to the feed point 213. One end of the second connecting portion 13 is electrically connected to the first portion A1. Another end of the second connecting portion 13 is electrically grounded to the first ground point 211 through the first switching circuit 14 and the third matching circuit 19. One end of the third connecting portion 15 is electrically connected to the second radiating portion E2. Another end of the third connecting portion 15 is electrically grounded to the second ground point 212 through the first matching circuit 16. The third connecting portion 15 is further electrically grounded to the second ground point 212 through the second switching circuit 17 and the second matching circuit 18 connected in series.

The antenna structure 400 differs from the antenna structure 100 in that a location of the slot 407 is different from the location of the slot 107 of the antenna structure 100. The slot 407 is substantially U-shaped. The slot 407 is defined on the side frame 102 instead of being defined on the backboard 101. That is, the first portion A1 is completely formed by the side frame 102. The backboard 11 is a complete sheet and there is no gap and/or groove defined on the backboard 101. The first portion A1 is spaced apart from the backboard 11. A distance D is formed between the first portion A1 and the backboard 11. The antenna structure 400 has a good radiation efficiency through adjusting the distance D. In this exemplary embodiment, a width of the distance D is about 1-20 mm. The antenna structure 400 can be applied to the wireless communication device with a full-screen design.

When the wireless communication device has a full-screen design, if the backboard 101 is made of metallic material, the metallic backboard 101 will affect a radiating efficiency of the antenna structure 400. In this exemplary embodiment, the backboard 101 is made of nonmetallic material.

Figure 16:
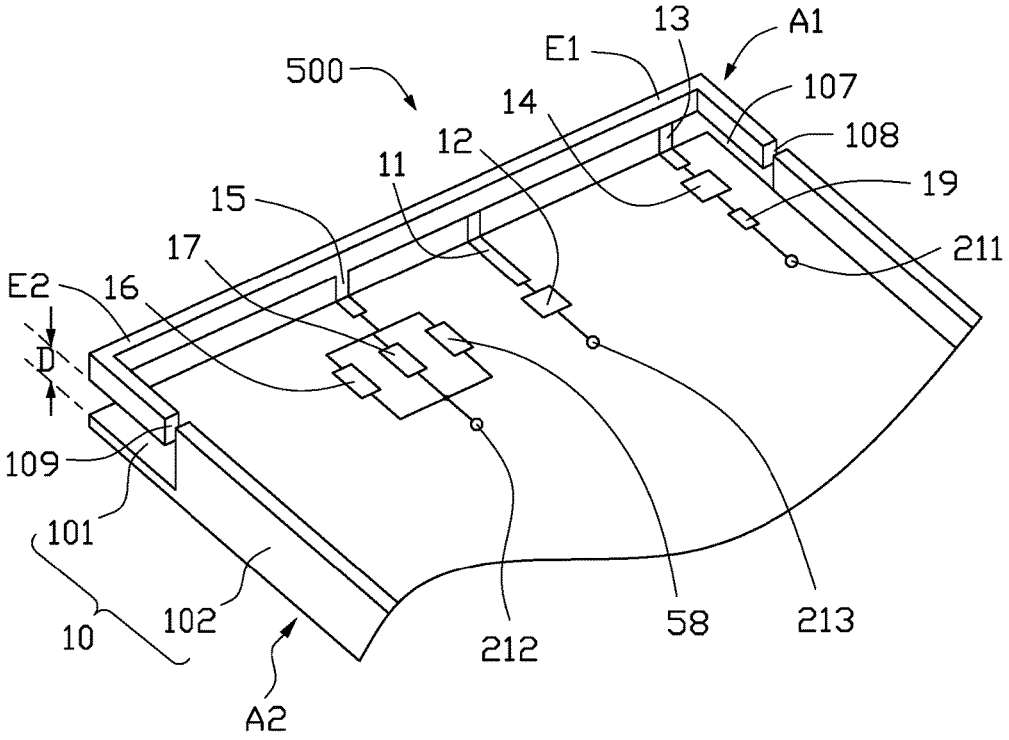
FIG. 16 is an isometric view of a fourth exemplary embodiment of an antenna structure.

FIG. 16 illustrates a fourth exemplary antenna structure 500. The antenna structure 500 includes a housing 10, a first connecting portion 11, a matching unit 12, a second connecting portion 13, a first switching circuit 14, a third connecting portion 15, a first matching circuit 16, a second switching circuit 17, and a third matching circuit 19.

One end of the first connecting portion 11 is electrically connected to the first portion A1. Another end of the first connecting portion 11 is electrically connected to the feed point 213. One end of the second connecting portion 13 is electrically connected to the first portion A1. Another end of the second connecting portion 13 is electrically grounded to the first ground point 211 through the first switching circuit 14 and the third matching circuit 19. One end of the third connecting portion 15 is electrically connected to the second radiating portion E2. Another end of the third connecting portion 15 is electrically grounded to the second ground point 212 through the first matching circuit 16.

In this exemplary embodiment, the first matching circuit 16 is a capacitor. In other exemplary embodiments, the first matching circuit 16 can be an L-type matching circuit, a T-type matching circuit, a π-type matching circuit, or other capacitors, inductors, or a combination of the capacitors and the inductors.

In this exemplary embodiment, the third connecting portion 15 is electrically connected to the second ground point 212 through the second switching circuit 17. That is, the first matching circuit 16 and the second switching circuit 17 are connected in parallel between the third connecting portion 15 and the second ground point 212.

In this exemplary embodiment, the antenna structure 500 differs from the antenna structure 400 in that the second matching circuit 18 is omitted and the antenna structure 500 further includes a third switching circuit 58. One end of the third switching circuit 58 is electrically connected to the third connecting portion 15 and is electrically connected to the second radiating portion E2 through the third connecting portion 15. Another end of the third switching circuit 58 is electrically grounded to second ground point 212.

In this exemplary embodiment, a detail circuit and a working principle of the third switching circuit 58 can consult a description of the first switching circuit 14 and the second switching circuit 17.

In this exemplary embodiment, the second radiating portion E2 forms a main resonance path of the low frequency band (700-1500 MHz) of the antenna structure 400. The triple frequency multiplied by the low frequency path may cause the antenna structure 500 to cover a corresponding high frequency band (2500-2690 MHz). The antenna structure 500 includes a first matching circuit 16, which will cause the antenna structure 500 to activate an additional middle frequency band (1710-1880 MHz). The feed point 213, the matching unit 12, the first connecting portion 11, and the first radiating portion E1 can cooperatively activate a middle frequency band (1880-2400 MHz). In this configuration, the matching unit 12 can match and adjust the entire frequency bands of the antenna structure 500, i.e., the low, middle, and high frequency bands. A double-switching design formed by the second switching circuit 17 and the third switching circuit 58 can perform a wide range of frequency adjustment on the low frequency band of the antenna structure 500. In addition, the middle frequency band of the antenna structure 500 can be adjusted in a wide range by the design of the first switching circuit 14.

Figure 17:
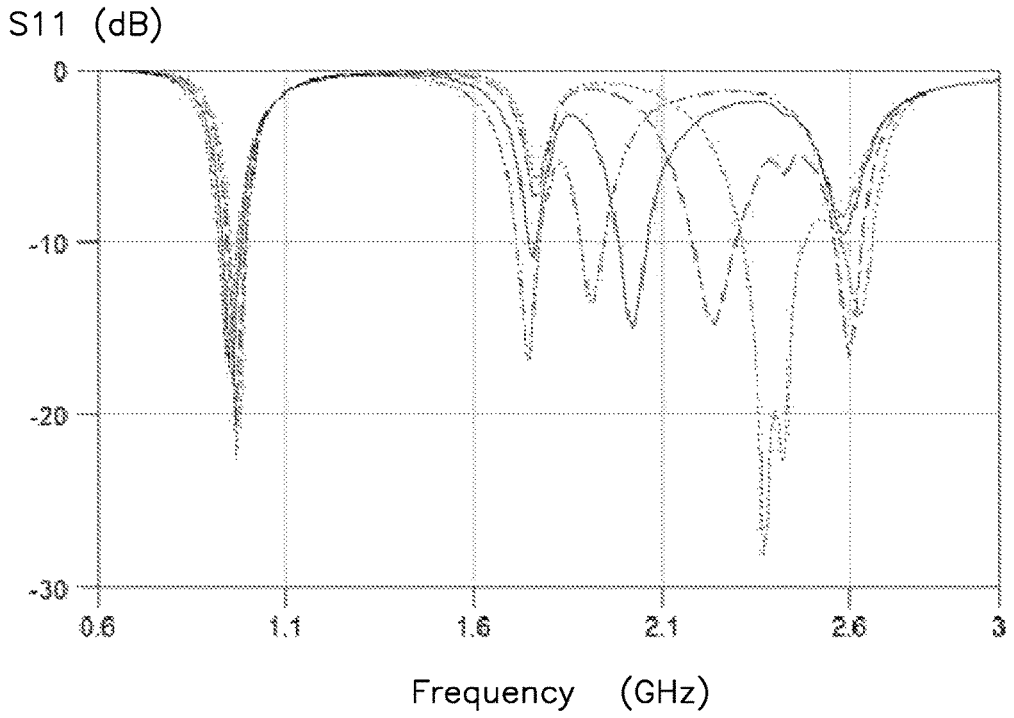
FIG. 17 is a scattering parameter graph illustrating the first switching circuit of FIG. 16 switching to different switching elements.

FIG. 17 illustrates a scattering parameter graph of the antenna structure 500 when the first switching circuit 14 switches to different first switching elements 143. When the first switch 141 of the first switching circuit 14 switches to different first switching elements 143 (for example three different first switching elements 143), each first switching element 143 has a different impedance. Then the middle frequency band of the antenna structure 500 can be adjusted thereby and the antenna structure 500 can obtain a good operation bandwidth.

Figure 18:
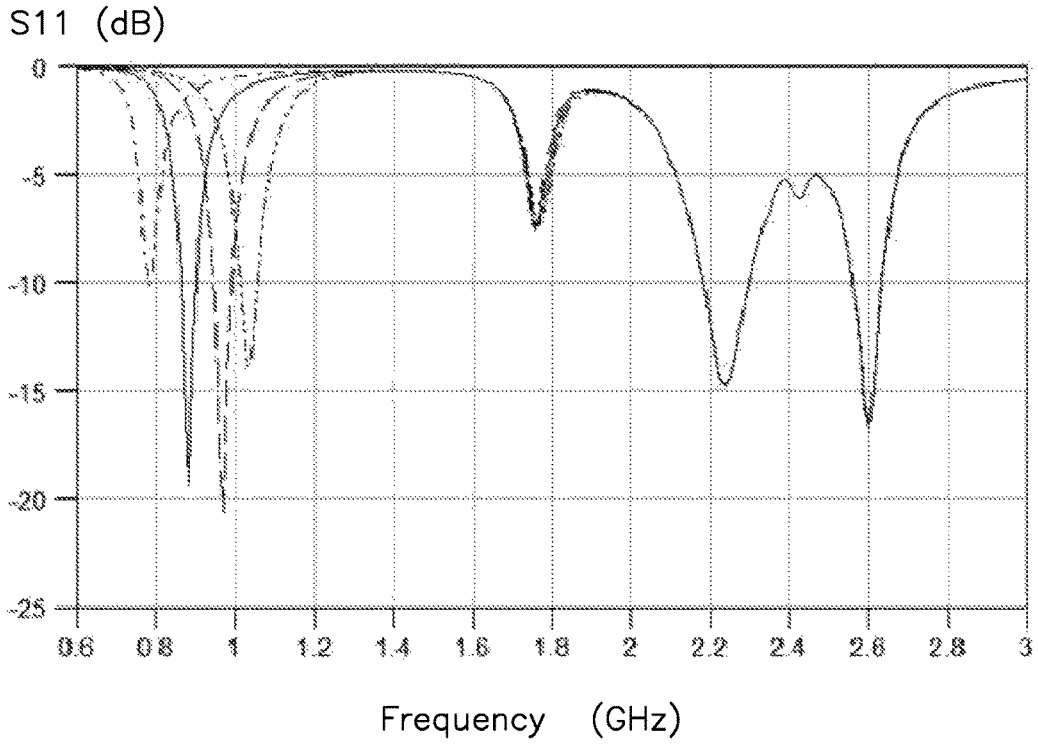
FIG. 18 is a scattering parameter graph illustrating the second switching circuit and the third switching circuit of FIG. 16 switching to different switching elements.

FIG. 18 illustrates a scattering parameter graph of the antenna structure 500 when the second switching circuit 17 and the third switching circuit 58 switch to different switching elements. The antenna structure 500 can switch to different switching elements (for example four different switching elements) through a double-switching design formed by the second switching circuit 17 and the third switching circuit 58. Then the low frequency band of the antenna structure 500 can be adjusted. In this exemplary embodiment, the second switching circuit 17 and the third switching circuit 18 can be switched individually or switched simultaneously.

Figure 19:
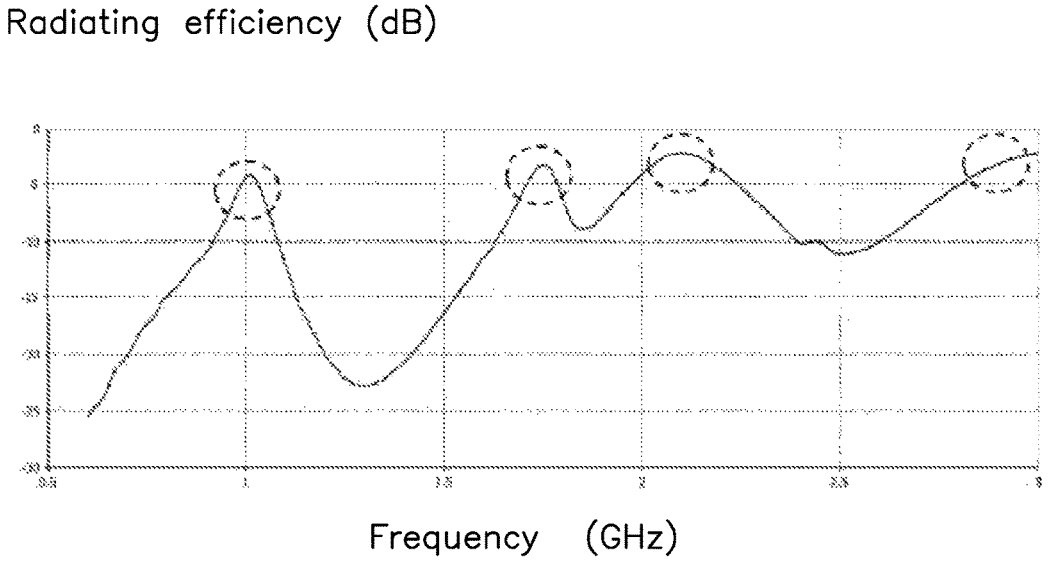
FIG. 19 is a radiating efficiency graph of the antenna structure of FIG. 16.

FIG. 19 illustrates a radiating efficiency graph of the antenna structure 500. The antenna structure 500 may completely cover the system bandwidth required for the currently used communication system. For example, the low frequency of the antenna structure 500 may cover 700-960 MHz. The middle and high frequencies of the antenna structure 500 may cover 1710-1880 MHz, 2000-2300 MHz, and 2496-2690 MHz. In addition, a radiating efficiency of the antenna structure 500 at each frequency band is above −5 dB, which satisfies antenna design requirements.

Figure 20:
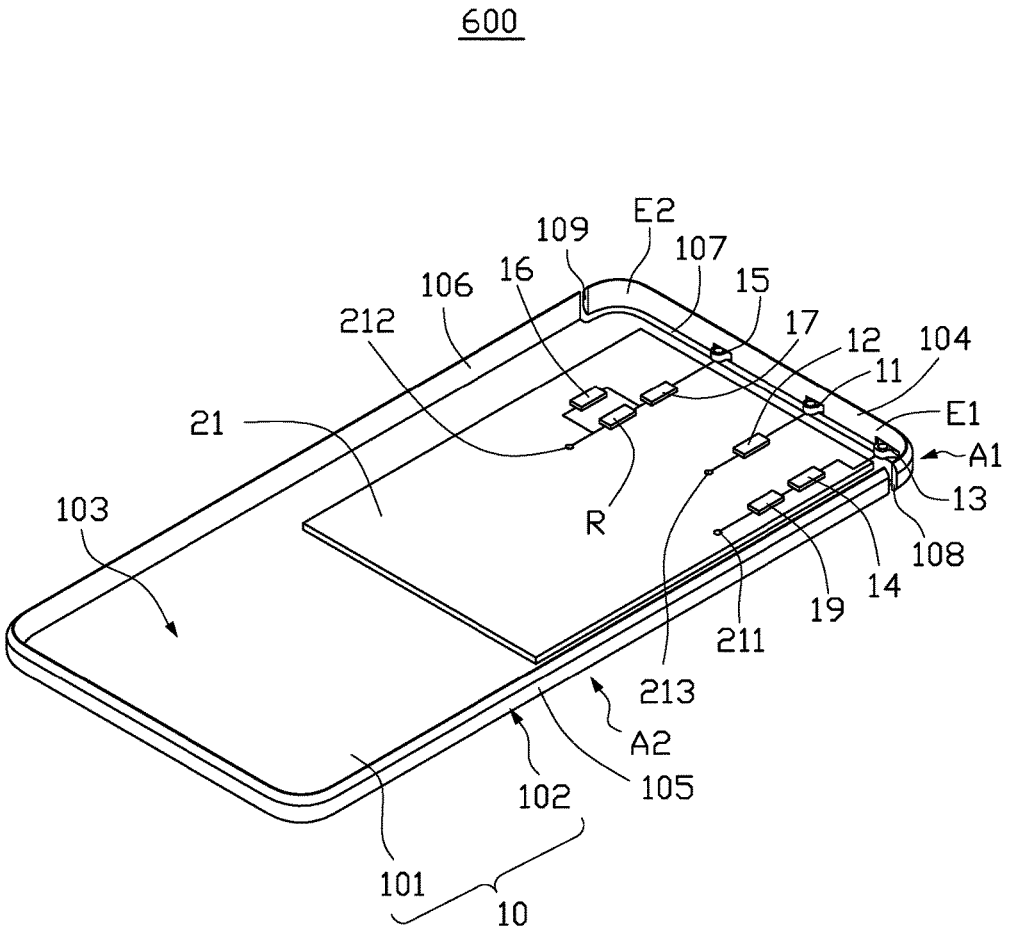
FIG. 20 is an isometric view of a fifth exemplary embodiment of an antenna structure.

FIG. 20 illustrates a fifth exemplary antenna structure 600. The antenna structure 600 includes a housing 10, a first connecting portion 11, a matching unit 12, a second connecting portion 13, a first switching circuit 14, a third connecting portion 15, a first matching circuit 16, a second switching circuit 17, and a third matching circuit 19.

One end of the first connecting portion 11 is electrically connected to the first portion A1. Another end of the first connecting portion 11 is electrically connected to the feed point 213 through the matching unit 12. One end of the second connecting portion 13 is electrically connected to the first portion A1. Another end of the second connecting portion 13 is electrically grounded to the first ground point 211 through the first switching circuit 14 and the third matching circuit 19. One end of the third connecting portion 15 is electrically connected to the second radiating portion E2. Another end of the third connecting portion 15 is electrically grounded to the second ground point 212 through the second switching circuit 17 and the first matching circuit 16.

The antenna structure 600 differs from the antenna structure 100 in that the second matching circuit 18 is omitted and the antenna structure 600 further includes a resistor unit R. The first matching circuit 16 and the resistor R are connected in parallel. The first matching circuit 16 and the resistor R connected in parallel are further connected between the second switching circuit 17 and the second ground point 212. That is, one end of the first matching circuit 16 is electrically connected to one end of the second switching circuit 17 and one end of the resistor unit R. Another end of the first matching circuit 16 is electrically connected to another end of the resistor unit R and the second ground point 212. The resistor unit R has a predetermined resistance. In this exemplary embodiment, the resistor unit R is a conductive line made by a conductor and an ideal resistance value of the resistor unit R is about zero ohms.

Figure 21:
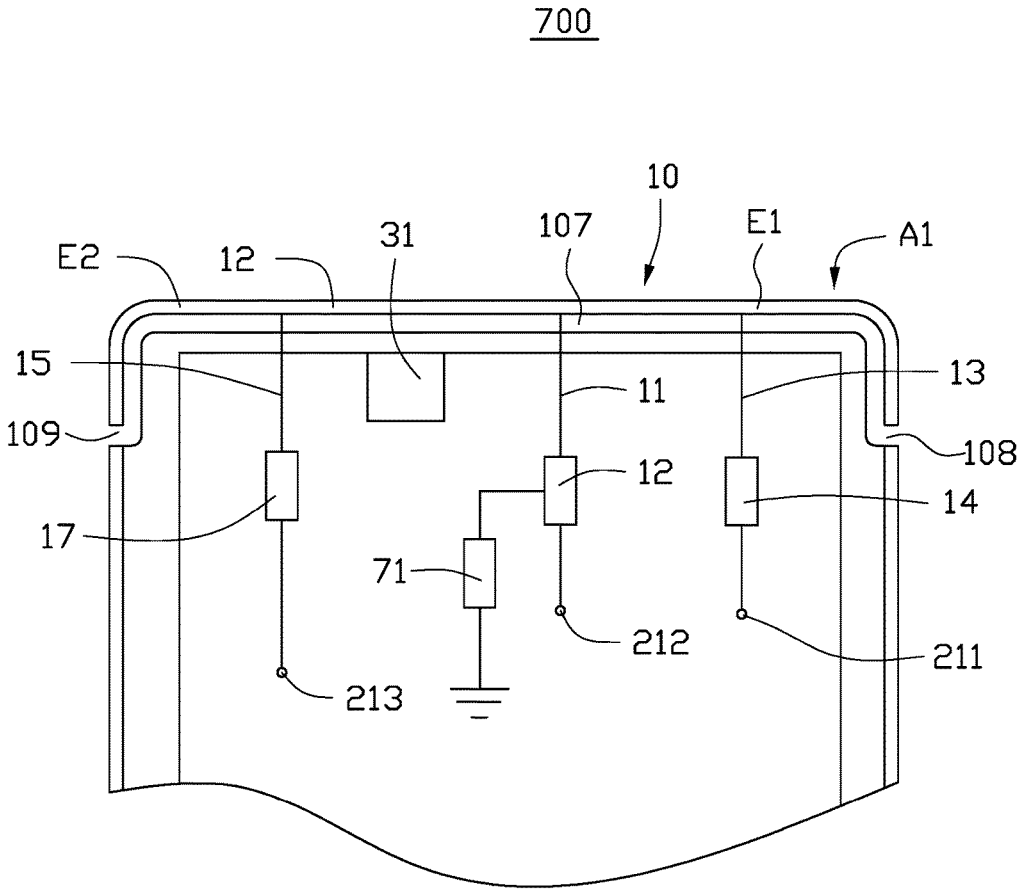
FIG. 21 is an isometric view of a sixth exemplary embodiment of an antenna structure.

FIG. 21 illustrates a sixth exemplary antenna structure 700. The antenna structure 700 includes a housing 10, a first connecting portion 11, a matching unit 12, a second connecting portion 13, a first switching circuit 14, a third connecting portion 15, and a second switching circuit 17.

One end of the first connecting portion 11 is electrically connected to the first portion A1. Another end of the first connecting portion 11 is electrically connected to the feed point 213 through the matching unit 12. One end of the second connecting portion 13 is electrically connected to the first radiating portion E1. Another end of the second connecting portion 13 is electrically grounded to the first ground point 211 through the first switching circuit 14. One end of the third connecting portion 15 is electrically connected to the second radiating portion E2. Another end of the third connecting portion 15 is electrically grounded to the second ground point 212 through the second switching circuit 17.

The antenna structure 700 differs from the antenna structure 300 in that the first matching circuit 16, the second matching circuit 18, and the third matching circuit 19 are all omitted. The antenna structure 700 further includes a switching module 71. One end of the switching module 71 is electrically connected to the matching unit 12. Another end of the switching module 71 is grounded.

Figure 22:
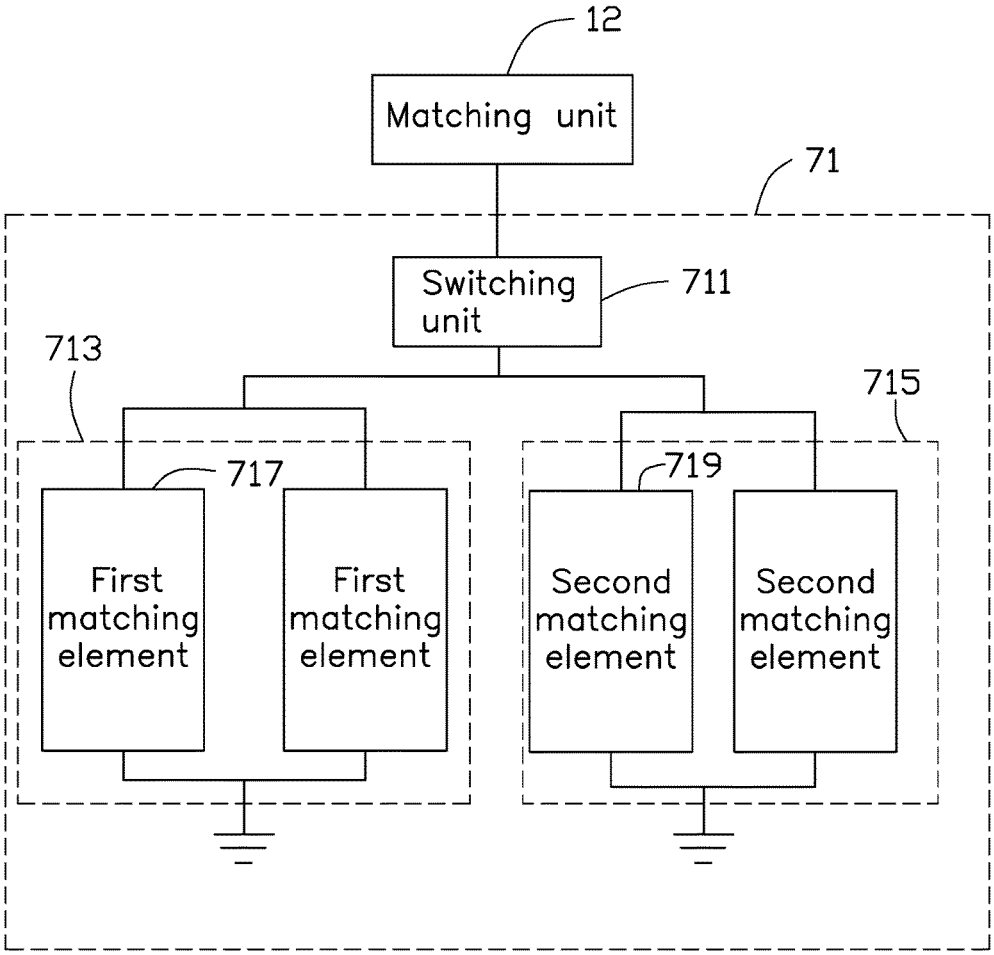
FIG. 22 is a circuit diagram of a third switching circuit of the antenna structure of FIG. 21.

As illustrated in FIG. 22, in this exemplary embodiment, the switching module 71 includes a switching unit 711 and at least one matching element. The switching unit 711 can be a single pole single throw switch, a single pole double throw switch, a single pole three throw switch, a single pole four throw switch, a single pole six throw switch, a single pole eight throw switch, or the like. The switching unit 711 is electrically connected to the matching unit 12 and is electrically connected to the first connecting portion 11 through the matching unit 12.

In this exemplary embodiment, the switching module 71 includes two groups of matching elements, that is, a first group of matching elements 713 and a second group of matching elements 715. The first group of matching elements 713 and the second group of matching elements 715 are connected in parallel. One end of the first group of matching elements 713 and the second group of matching elements 715 is electrically connected to the switching unit 711. Another end of the first group of matching elements 713 and the second group of matching elements 715 is grounded.

In this exemplary embodiment, the first group of matching elements 713 includes two first matching elements 717. One first matching element 717 is an inductor having an inductance value of about 4.7 nH. The other first matching element 717 is a capacitor having a capacitance value of about 2.2 pF. The two first matching elements 717 are connected in parallel. One end of each of the two first matching elements 717 is electrically connected to the switching unit 711. Another end of each of the two first matching elements 717 is grounded.

In other exemplary embodiments, the two first matching elements 717 can be an inductor, a capacitor, or a combination of the inductor and the capacitor. A number of the first matching elements 717 can also be adjustable.

In this exemplary embodiment, the second group of matching elements 715 includes two second matching elements 719. One second matching element 719 is an inductor having an inductance value of about 15 nH. The other second matching element 719 is a capacitor having a capacitance value of about 0.7 pF. The two second matching elements 719 are connected in parallel. One end of each of the two second matching elements 719 is electrically connected to the switching unit 711. Another end of each of the two second matching elements 719 is grounded.

In other exemplary embodiments, the two second matching elements 719 can be an inductor, a capacitor, or a combination of the inductor and the capacitor. A number of the second matching elements 719 can also be adjustable.

Figure 23:
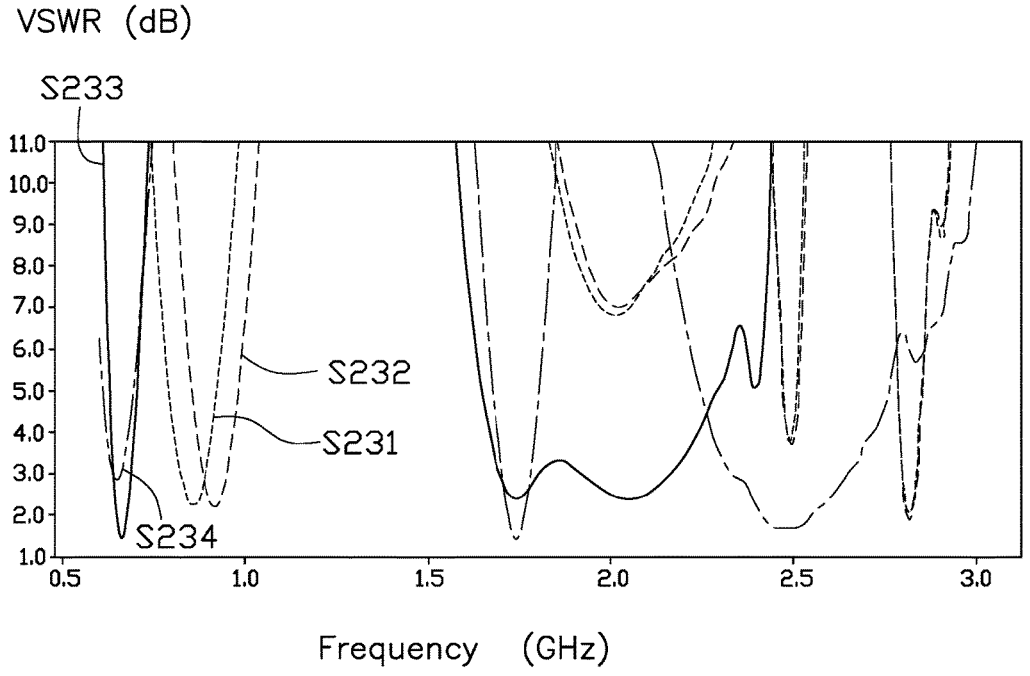
FIG. 23 is a voltage standing wave ratio (VSWR) graph of the antenna structure of FIG. 21.

FIG. 23 illustrates a voltage standing wave ratio (VSWR) graph of the antenna structure 700. Curve S231 illustrates a VSWR when the antenna structure 700 operates at the frequency band of LTE band 5. Curve S232 illustrates a VSWR when the antenna structure 700 operates at the frequency band of LTE band 8. Curve S233 illustrates a VSWR when the antenna structure 700 operates at the 1800/900 frequency band. Curve S234 illustrates a VSWR when the antenna structure 700 operates at the frequency band of LTE band 7/38/40/41.

Figure 24:
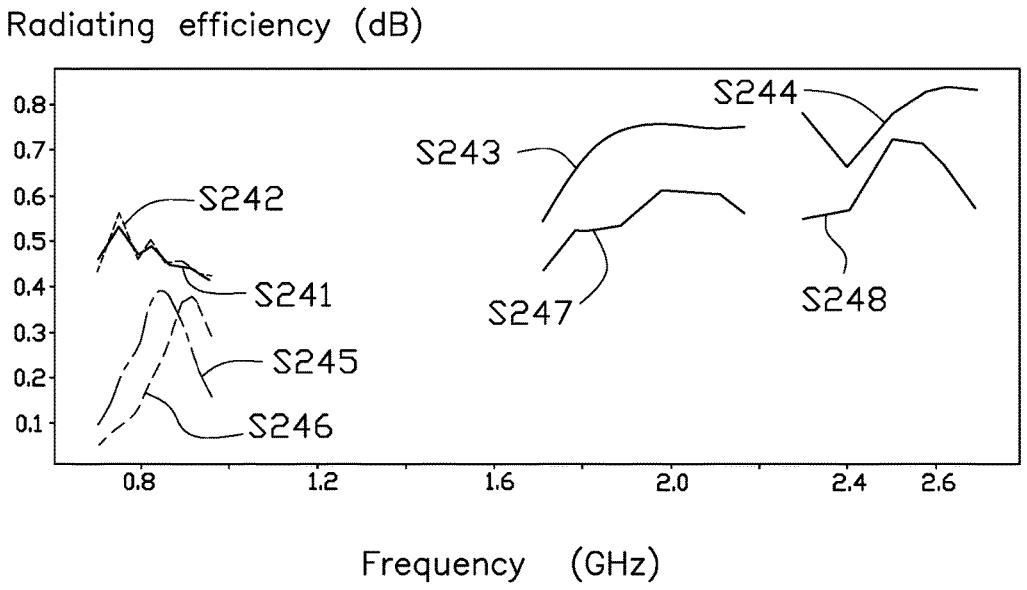
FIG. 24 is a radiating efficiency graph of the antenna structure of FIG. 21.

FIG. 24 illustrates a radiating efficiency graph of the antenna structure 700. Curve S241 illustrates a radiating efficiency when the antenna structure 700 operates at the frequency band of LTE band 5. Curve S242 illustrates a radiating efficiency when the antenna structure 700 operates at the frequency band of LTE band 8. Curve S243 illustrates a radiating efficiency when the antenna structure 700 operates at the 1800/900 frequency band. Curve S244 illustrates a radiating efficiency when the antenna structure 700 operates at the frequency bands of LTE band 7/38/40/41. Curve S245 illustrates a total radiating efficiency when the antenna structure 700 operates at the frequency band of LTE band 5. Curve S246 illustrates a total radiating efficiency when the antenna structure 700 operates at the frequency band of LTE band 8. Curve S247 illustrates a total radiating efficiency when the antenna structure 700 operates at the 1800/900 frequency band. Curve S248 illustrates a total radiating efficiency when the antenna structure 700 operates at the frequency bands of LTE band 7/38/40/41.

The following table 1 illustrates an operating frequency band of the antenna structure 700 when the first switching circuit 14, the second switching circuit 17, and the switching module 71 are of different configurations.

TABLE 1

| Operating Frequency Band | | | Switching State | | |
|---|---|---|---|---|---|
| | | | First Switching | Second Switching | Switching |
| 2G | 3G | 4G | Circuit | Circuit | Module |
| 850 | Band 5 | Band 5 | 0 ohms | 33 nH | Second group of matching elements |
| 900 | Band 8 | Band 8 | 0 ohms | 18 nH | Second group of matching elements |
| 1800/1900 | Band 1/2/3/4 | Band 1/2/3/34/39 | 3.3 nH | 1.6 pF | First group of matching elements |
| | | Band 7/38/40/41 | 0 ohms | 1.5 pF | First group of matching elements |

The following table 2 illustrates a total radiating efficiency and a gain when the antenna structure 700 works at corresponding operating frequency bands.

TABLE 2

| Frequency Band | Frequencies (MHz) | Total Radiating Efficiency (%) | Gain (dB) |
|---|---|---|---|
| Band 5 | 824 | 36.8 | −4.3 |
| | 849 | 39.3 | −4.1 |
| | 869 | 37.1 | −4.3 |
| | 894 | 32.4 | −4.9 |
| Band 8 | 880 | 33.2 | −4.8 |
| | 915 | 37.9 | −4.2 |
| | 925 | 36.8 | −4.3 |
| | 960 | 29.0 | −5.4 |
| Band 3 | 1710 | 43.1 | −3.7 |
| | 1785 | 52.4 | −2.8 |
| | 1805 | 52.3 | −2.8 |
| | 1880 | 53.3 | −2.7 |
| Band 2 | 1850 | 52.3 | −2.8 |
| | 1910 | 55.3 | −2.6 |
| | 1930 | 56.9 | −2.5 |
| | 1990 | 61.9 | −2.1 |
| Band 1/34 | 1920 | 56.1 | −2.5 |
| | 1980 | 61.1 | −2.1 |
| | 2110 | 60.2 | −2.2 |
| | 2170 | 55.8 | −2.5 |
| Band 40 | 2300 | 54.6 | −2.6 |
| | 2400 | 56.7 | −2.5 |
| Band 7/38/41 | 2500 | 72.6 | −1.4 |
| | 2570 | 71.2 | −1.5 |
| | 2620 | 66.0 | −1.8 |
| | 2690 | 57.6 | −2.4 |

The antenna structure 100/200/300/400/500/600/700 includes the housing 10 and at least two switching circuits, for example, the first switching circuit 14 and the second switching circuit 17, which cooperatively control the low, middle and high frequency bands of the antenna structure 100/200/300/400/500/600/700 and also satisfy requirements of the carrier aggregation (CA) technology of Long Term Evolution Advanced (LTE-A).

The embodiments shown and described above are only examples. Many details are often found in the art such as the other features of the antenna structure and the wireless communication device. Therefore, many such details are neither shown nor described. Even though numerous characteristics and advantages of the present disclosure have been set forth in the foregoing description, together with details of the structure and function of the present disclosure, the disclosure is illustrative only, and changes may be made in the details, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. An antenna structure comprising:

a housing, the housing defining a slot, a first gap, and a second gap; wherein the first gap and the second gap are in air communication with the slot, the housing is divided into a first portion and a second portion by the slot, the first gap, and the second gap; and wherein the second portion is grounded;

a first connecting portion, one end of the first connecting portion electrically connected to the first portion; wherein the first portion is divided into a first radiating portion and a second radiating portion by the first connecting portion;

a matching unit, another end of the first connecting portion electrically connected to a feed point through the matching unit;

a second connecting portion; and a first switching circuit;

wherein one end of the second connecting portion is electrically connected to the first radiating portion, and another end of the second connecting portion is grounded through the first switching circuit.

2. The antenna structure of claim 1, wherein the housing comprises a backboard and a side frame, the side frame is positioned around a periphery of the backboard, the slot is defined on the backboard or the side frame; and wherein the first gap and the second gap are defined on the side frame.

3. The antenna structure of claim 1, wherein when the feed point supplies current, the current flows through the matching unit and the first connecting portion and flows through the first radiating portion so that the first radiating portion activates a first operation mode to generate radiation signals in a first frequency band; wherein the current from the first connecting portion further flows through the second radiating portion so that the second radiating portion activates a second operation mode to generate radiation signals in a second frequency band, and a frequency of the first frequency band is higher than a frequency of the second frequency band.

4. The antenna structure of claim 3, wherein the first switching circuit comprises a first switch and a plurality of first switching elements, the first switch is electrically connected to the first radiating portion, the first switching elements are connected in parallel to each other, one end of each first switching element is electrically connected to the first switch, and the other end of each first switching element is grounded; through controlling the first switch to switch, the first radiating portion is switched to different first switching elements and the first frequency band is adjusted.

5. The antenna structure of claim 1, further comprising a third connecting portion and a second switching circuit, wherein one end of the third connecting portion is electrically connected to the second radiating portion, and another end of the third connecting portion is grounded through the second switching circuit.

6. The antenna structure of claim 5, further comprising a first matching circuit and a resistor unit, wherein the first matching circuit and the resistor unit are connected in parallel, the first matching circuit and the resistor unit connected in parallel are further connected between the second switching circuit and ground.

7. The antenna structure of claim 5, further comprising a first matching circuit and a second matching circuit, wherein the second switching circuit and the second matching circuit are connected in series, the second switching circuit and the second matching circuit connected in series are further connected between the third connecting portion and ground; wherein the first matching circuit is connected in parallel with the second switching circuit and the second matching circuit connected in series.

8. The antenna structure of claim 5, further comprising a first matching circuit and a third switching circuit, wherein one end of the first matching circuit is electrically connected to the third connecting portion, another end of the first matching circuit is grounded; wherein one end of the third switching circuit is electrically connected to the third connecting portion, another end of the third switching circuit is grounded.

9. The antenna structure of claim 5, wherein the second switching circuit comprises a second switch and a plurality of second switching elements, the second switch is electrically connected to the second radiating portion, the second switching elements are connected in parallel to each other, one end of each second switching element is electrically connected to the second switch, and the other end of each second switching element is grounded; through controlling the second switch to switch, the second radiating portion is switched to different second switching elements and the second frequency band is adjusted.

10. The antenna structure of claim 5, further comprising a third matching circuit, wherein one end of the third matching circuit is electrically connected to the first switching circuit, another end of the third matching circuit is grounded; the third matching circuit adjusts an impedance matching of the first radiating portion.

11. The antenna structure of claim 5, further comprising an electronic element, wherein the electronic element is between the first connecting portion and the third connecting portion, the electronic element is spaced apart from the housing.

12. The antenna structure of claim 5, further comprising a switching module, wherein one end of the switching module is electrically connected to the matching unit, another end of the switching module is grounded.

13. The antenna structure of claim 12, wherein the switching module comprises a switching unit and a plurality of groups of matching elements, the groups of matching elements are connected in parallel to each other, one end of each group of matching elements is electrically connected to the switching unit, and the other end of each group of matching elements is grounded.

14. The antenna structure of claim 13, wherein the switching module comprises a first group of matching elements and a second group of matching elements, the first group of matching elements comprises a plurality of first matching elements, the first matching elements are connected in parallel, one end of each first matching element is electrically connected to the switching unit, and another end of each first matching element is grounded; wherein the second group of matching elements comprises a plurality of second matching elements, the second matching elements are connected in parallel, one end of each second matching element is electrically connected to the switching unit, and another end of each second matching element is grounded.

15. The antenna structure of claim 1, wherein a wireless communication device having the first portion to receive or transmit wireless signals at multiple frequency bands simultaneously through carrier aggregation (CA) technology of Long Term Evolution Advanced (LTE-A).

16. A wireless communication device comprising:

an antenna structure, the antenna structure comprising:

a housing, the housing defining a slot, a first gap, and a second gap; wherein the first gap and the second gap are in air communication with the slot, the housing is divided into a first portion and a second portion by the slot, the first gap, and the second gap; and wherein the second portion is grounded;

a first connecting portion, one end of the first connecting portion electrically connected to the first portion; wherein the first portion is divided into a first radiating portion and a second radiating portion by the first connecting portion;

a matching unit, another end of the first connecting portion electrically connected to a feed point through the matching unit;

a second connecting portion; and a first switching circuit;

wherein one end of the second connecting portion is electrically connected to the first radiating portion, and another end of the second connecting portion is grounded through the first switching circuit.

17. The wireless communication device of claim 16, wherein the housing comprises a backboard and a side frame, the side frame is positioned around a periphery of the backboard, the backboard and side frame form an appearance housing of the wireless communication device; wherein the slot is defined on the backboard or the side frame; and wherein the first gap and the second gap are defined on the side frame.

18. The wireless communication device of claim 16, wherein when the feed point supplies current, the current flows through the matching unit and the first connecting portion and flows through the first radiating portion so that the first radiating portion activates a first operation mode to generate radiation signals in a first frequency band; wherein the current from the first connecting portion further flows through the second radiating portion so that the second radiating portion activates a second operation mode to generate radiation signals in a second frequency band, and a frequency of the first frequency band is higher than a frequency of the second frequency band; and wherein first frequency band is adjusted by the first switching circuit.

19. The wireless communication device of claim 16, wherein the antenna structure further comprises a third connecting portion and a second switching circuit, one end of the third connecting portion is electrically connected to the second radiating portion, and another end of the third connecting portion is grounded through the second switching circuit; and wherein the second frequency band is adjusted by the second switching circuit.

20. The wireless communication device of claim 19, wherein the antenna structure further comprises a first matching circuit and a resistor unit, the first matching circuit and the resistor unit are connected in parallel, the first matching circuit and the resistor unit connected in parallel are further connected between the second switching circuit and ground.

21. The wireless communication device of claim 19, wherein the antenna structure further comprises a first matching circuit and a second matching circuit, the second switching circuit and the second matching circuit are connected in series, the second switching circuit and the second matching circuit connected in series are further connected between the third connecting portion and ground; wherein the first matching circuit is connected in parallel with the second switching circuit and the second matching circuit connected in series.

22. The wireless communication device of claim 19, wherein the antenna structure further comprises a first matching circuit and a third switching circuit, one end of the first matching circuit is electrically connected to the third connecting portion, another end of the first matching circuit is grounded; wherein one end of the third switching circuit is electrically connected to the third connecting portion, another end of the third switching circuit is grounded.

23. The wireless communication device of claim 19, wherein the antenna structure further comprises a third matching circuit, one end of the third matching circuit is electrically connected to the first switching circuit, another end of the third matching circuit is grounded; the third matching circuit adjusts an impedance matching of the first radiating portion.

24. The wireless communication device of claim 19, wherein the antenna structure further comprises an electronic element, the electronic element is between the first connecting portion and the third connecting portion, the electronic element is spaced apart from the housing.

25. The wireless communication device of claim 19, wherein the antenna structure further comprises a switching module, one end of the switching module is electrically connected to the matching unit, another end of the switching module is grounded.

* * * * *